United States Patent [19]

Geiger

[11] 4,254,816

[45] Mar. 10, 1981

[54] APPARATUS FOR MANUFACTURING MOLD PARTS

[75] Inventor: Werner Geiger, Meggen, Switzerland

[73] Assignee: Inventio AG, Hergiswil, Switzerland

[21] Appl. No.: 76,255

[22] Filed: Sep. 17, 1979

[30] Foreign Application Priority Data

Oct. 5, 1978 [CH] Switzerland ..... 10340/78

[51] Int. Cl.[3] ..... B22C 15/08

[52] U.S. Cl. ..... 164/173; 164/212

[58] Field of Search ..... 164/172, 173, 210–212, 164/37–40, 204, 196–197

[56] References Cited

U.S. PATENT DOCUMENTS

| | | | |
|---|---|---|---|
| 356,856 | 2/1887 | Tasker | 164/172 |
| 1,846,306 | 2/1932 | Bunting et al. | 164/172 |

FOREIGN PATENT DOCUMENTS

| | | | |
|---|---|---|---|
| 45-22214 | 7/1970 | Japan | 164/172 |
| 325084 | 2/1972 | U.S.S.R. | 164/172 |

*Primary Examiner*—Robert D. Baldwin
*Assistant Examiner*—K. Y. Lin
*Attorney, Agent, or Firm*—Werner W. Kleeman

[57] ABSTRACT

An apparatus for fabricating boxless casting mold parts. During a first step the sand is pre-compacted in mold boxes or flasks by means of a pressure or compaction plate of a pressure or compaction device to form a casting mold part. Press or pressure punches are displaceably mounted in the pressure plate. By means of a pressurized fluid medium, introduced into a hollow chamber or space of the pressure or compaction device, the press or pressure punches are activated and, during a second step, cause a post-compaction of the casting mold part. There is thus produced an approximately uniform compaction of the casting mold part. The lower part of the pressure or compaction device is structured as the pressure or compaction plate serving for pre-compaction. This compaction plate is provided with recesses which receive the press punches which are arranged in spaced relationship from one another such that, after the compaction operation, there is formed a coherent ejection and standing or support surface of the mold part which is interrupted by recesses or depressions.

8 Claims, 3 Drawing Figures

APPARATUS FOR MANUFACTURING MOLD PARTS

BACKGROUND OF THE INVENTION

The present invention relates to a new and improved construction of apparatus for manufacturing boxless casting mold parts.

There are known to the art boxless casting molds composed of an upper part and a lower part, sometimes referred to as an upper mold half and a lower mold half. In contrast to casting molds in boxes or flasks they have the appreciable advantage that there is avoided the pronounced wear to which the molding boxes are subjected in the foundry during the circulation thereof through the foundry. On the other hand, they are associated with the drawback that, especially with markedly different pattern heights during the conventional automatic fabrication thereof, the molding sand, during compaction by means of a pressure or compaction plate, is only sufficiently, i.e., maximumly compacted at the regions above the high pattern parts, whereas at the remaining regions there is only produced an insufficient compaction of the molding sand. The different compaction of the mold parts therefore frequently leads to casting flaws or defects at the casting.

To avoid such defects it has already been proposed, following the compaction operation by means of the pressure plate, to subject the casting mold part to a post-compaction at the opposite side by raising the pattern support. However, in practice this technique only constitutes an apparent improvement, since during pre-compaction the sand region above the high pattern parts already has reached the threshold value of compaction. During post-compaction this threshold value is rapidly attained, if it has not already been reached during pre-compaction, so that the aforementioned sand region resists any further compaction. Consequently, the unsatisfactorily compacted sand region only can be post-compacted to a minimum degree or not at all.

During the manufacture of casting molds in flasks or boxes, when working with different heights of the pattern contours, the pressure plate is subdivided into a number of individually effective press punches. Each of these press punches only compacts a small region of the molding sand. In this way there is obtained an extremely uniform and good compaction of the entire mold part, wherein, however, corresponding to the pattern contour, there are formed higher and lower situated sand sections. Since, however, during the compaction operation there is still present the sand filling frame which has been placed upon the molding box or flask, after the removal of such frame there can be severed the sand sections protruding past the box edge, whereas the sections which are situated lower than the box edge do not disturb. Yet, the multi-punch system which has been found to be quite advantageous during the compaction of mold parts in flasks or boxes is unsuitable however for boxless mold parts, because the compaction occurs within the mold box or flask itself, and thus, the different height sand sections all are located below the mold box edge and cannot be severed or removed. Following the ejection out of the mold box, which is already difficult owing to the contour of the sand, there is thus missing at the lower mold part the flat standing surface needed for the further transport and at the upper mold part the flat support or contact surface for the weighting plate or the like.

SUMMARY OF THE INVENTION

Therefore, with the foregoing in mind it is a primary object of the present invention to provide a new and improved construction of apparatus for manufacturing boxless mold parts in a manner not afflicted with the aforementioned drawbacks and limitations of the prior art proposals.

Another and more specific object of the present invention aims at devising a new and improved construction of apparatus for manufacturing boxless mold parts wherein there is improved the insufficient compaction during fabrication of boxless mold parts, and the apparatus furthermore affords uniform and good compaction of the sand even when working with casting mold parts having markedly different contours of the patterns or models.

BRIEF DESCRIPTION OF THE DRAWINGS

The invention will be better understood and objects other than those set forth above, will become apparent when consideration is given to the following detailed description thereof. Such description makes reference to the annexed drawings wherein.

DETAILED DESCRIPTION OF THE PREFERRED EMBODIMENTS

Figure 1:
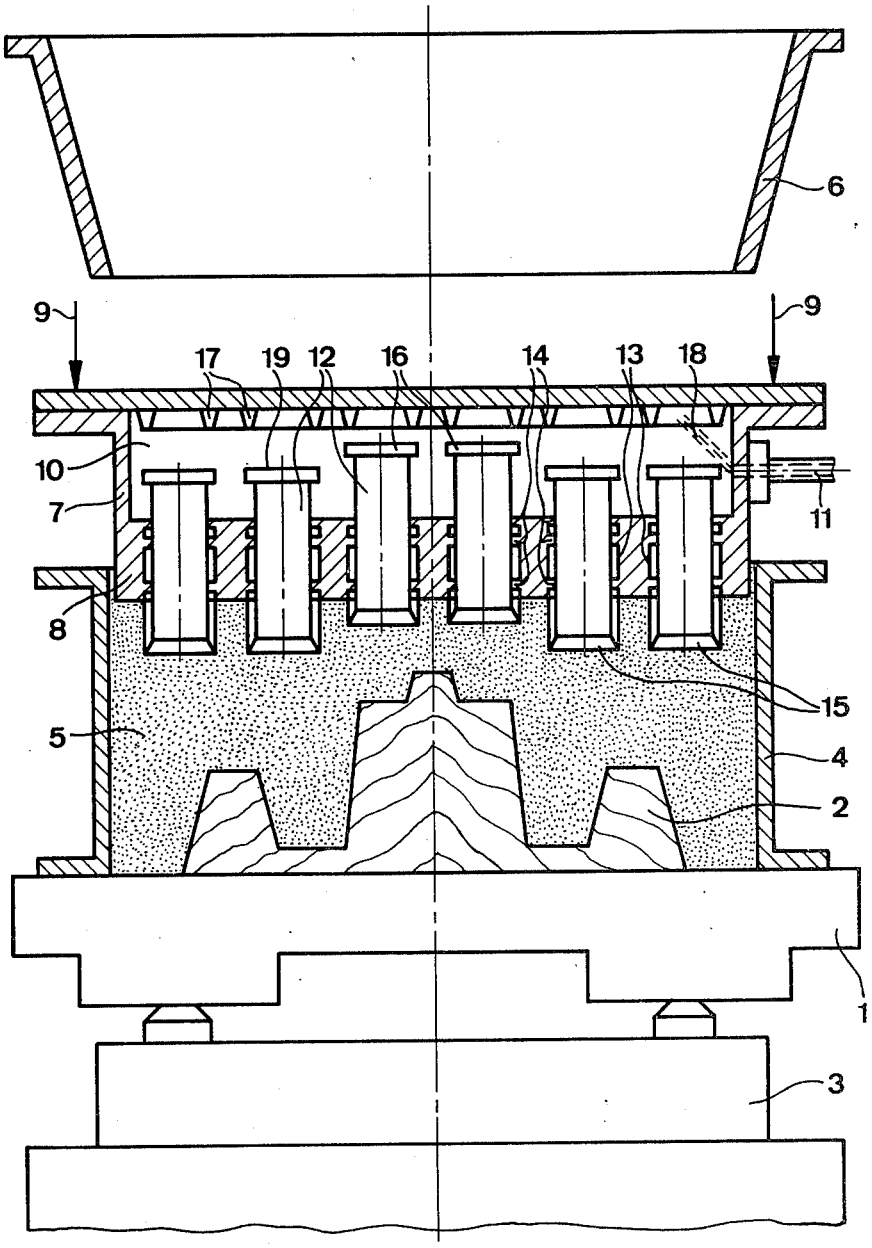
FIG. 1 is a side view, partially in section, of an apparatus for fabricating boxless casting mold parts according to the invention.

Describing now the drawings, it is to be understood that only enough of the construction of the molding machine for forming boxless mold parts has been shown to enable those skilled in the art to readily understand the underlying principles and concepts of the invention. Thus, by referring to FIG. 1, it will be observed that upon a pattern or match plate support 1 there is attached a pattern or model 2 which can have different contours. The match or pattern plate support 1 bears upon a support table 3 of a not further shown but conventional molding station of an automatic casting mold machine. A mold box or flask 4 for the reception of the molding sand and the mold part 5 formed after compaction of such sand, is placed upon the match plate support 1. Below a conventional sand filling device, wherein in FIG. 1 there has only been shown the filling funnel 6 or equivalent structure, there is located within the mold box or flask 4 a mobile pressure or compaction device 7 for the compaction of the mold part 5 and shown in its work position.

The lower part of the compaction device 7 is constructed as a press or pressure plate 8—sometimes also referred to as a compaction plate—which can be pressed in known fashion, for instance by any suitable means of standard design and therefore only generally indicated by the arrows 9, against the top surface of the sand of the mold part 5. Above the thick press or compaction plate 8 the compaction device 7 is provided with a hollow chamber or space 10 into which opens a connection conduit or pipe 11 through which flows a suitable pressurized fluid medium 18. At the press or compaction plate 8 there are distributed, at a substantially uniform spacing throughout such plate 8, a number of press or pressure punches 12 structured as cylinders. These press punches 12 are displacably mounted in bores 13 provided in the press or compaction plate 8. To outwardly seal the bores 13 against the action of the pressurized fluid medium 18 and against the inflow of sand through such bores 13 the latter are provided with projections 14 or equivalent structure which function as lip seals. The press punches 12 terminate below the press or compaction plate 8 in the form of outwardly conical projections or protuberances 15 and within the hollow chamber or space 10 terminate at substantially cylindrical projections or protuberances 16 or equivalent structure. In the rest state of the press punches 12, in other words when the hollow chamber or space 10 is under vacuum conditions, the conical projections 15 bear against the press or compaction plate 8, whereas the cylindrical projections 16 bear against boundary dogs or cams 17 arranged within such hollow chamber or space 10.

Now having had the benefit of the foregoing description of the exemplary embodiment of apparatus for manufacturing mold parts its mode of operation will be considered and is as follows:

The not particulary illustrated casting mold machine places the empty mold boxes or flasks 4 upon the match plate support 1. Since at this point in time the mobile pressure or compaction device 7 is not yet located between the filling funnel 6 and the mold box or flask 4, it is possible to fill the internal space of the mold box 4 with sand over the pattern or model 2. The filled molding and flows downwardly from the sand filling device through the sand filling funnel 6 into the mold box or flask 4. After the filling operation the pressure or compaction device 7 is moved between the filling funnel 6 and the mold box 4 and stopped in a position where is overlies the surface of the filled sand. The press punches 12 of the compaction device 7 are located in their rest condition, so that the projections 15 together with the pressure or compaction plate 8 practically form a pressing or compaction surface.

By the action of the pressure exerting means 9, which may be constituted for instance by any suitable drive such as a pressurized fluid medium drive, the compaction device 7 is lowered and the pressure or compaction plate 8 together with the projections 15 are pressed against the sand surface, with the result that the sand is compacted into the mold part 5. Still during the pressing of the compaction plate 8 against the mold part 5 there is infed, through the connection pipe or conduit 11, a suitable hydraulic or pneumatic pressurized fluid medium 18 into the hollow chamber or space 10. This pressurized fluid medium 18 now is effective between the boundary cams or dogs 17 against the base or top surface 19 of the press punches 12, so that the latter are raised from the boundary cams or dogs 17 and pressed with the same force out of the hollow chamber or space 10. Depending upon the pre-compaction of the mold part 5 the press punches 12 penetrate to a greater or lesser extent into the sand and, in this manner, cause a powerful post-compaction of the only slightly pre-compacted sand regions, so that there is obtained practically a uniform and sufficiently compacted mold part 5.

After the post-compaction the pressurized fluid medium 18 is sucked-out of the hollow chamber or space 10, resulting in return movement of the press punches 12 into their rest position. Thereafter, the compaction device 7 is raised out of the mold box or flask 4 and moved out of the region of such mold box 4. Then the casting machine transports the mold box 4 together with the mold part 5 to a not particularly illustrated but conventional ejection station, and the mold station is now ready to manufacture the next mold part.

Figure 2:
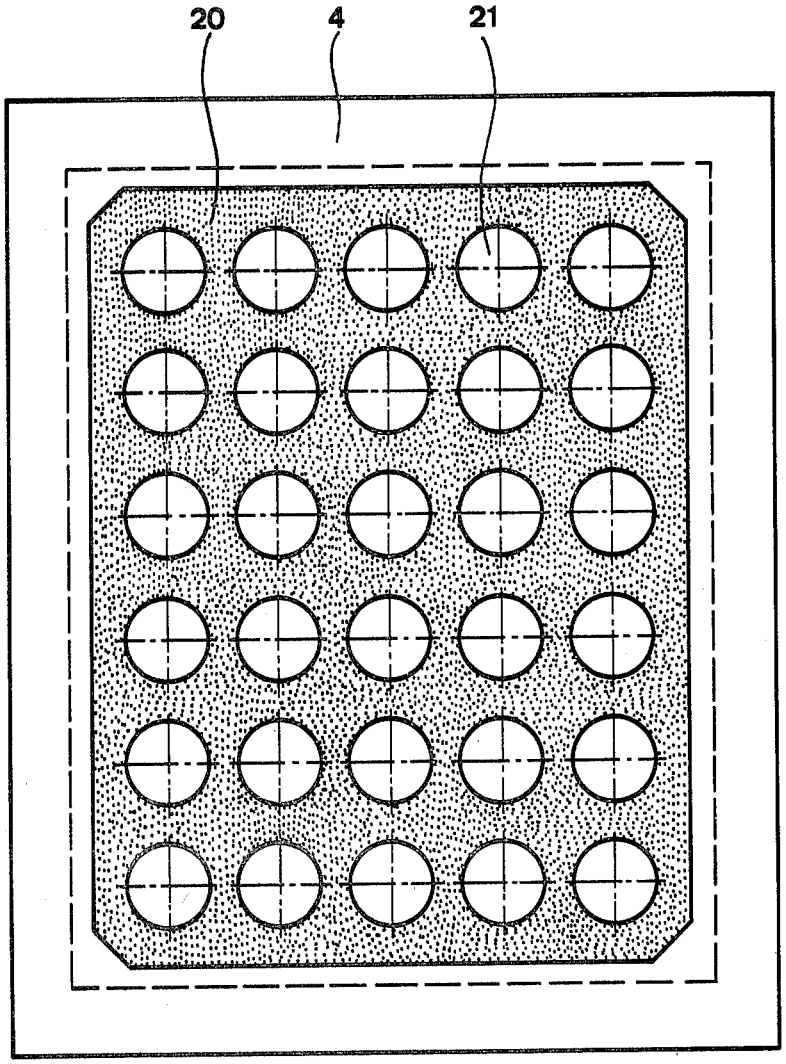
FIG. 2 is a top plan view of a casting mold part following the compaction in the mold box or flask.
Figure 3:
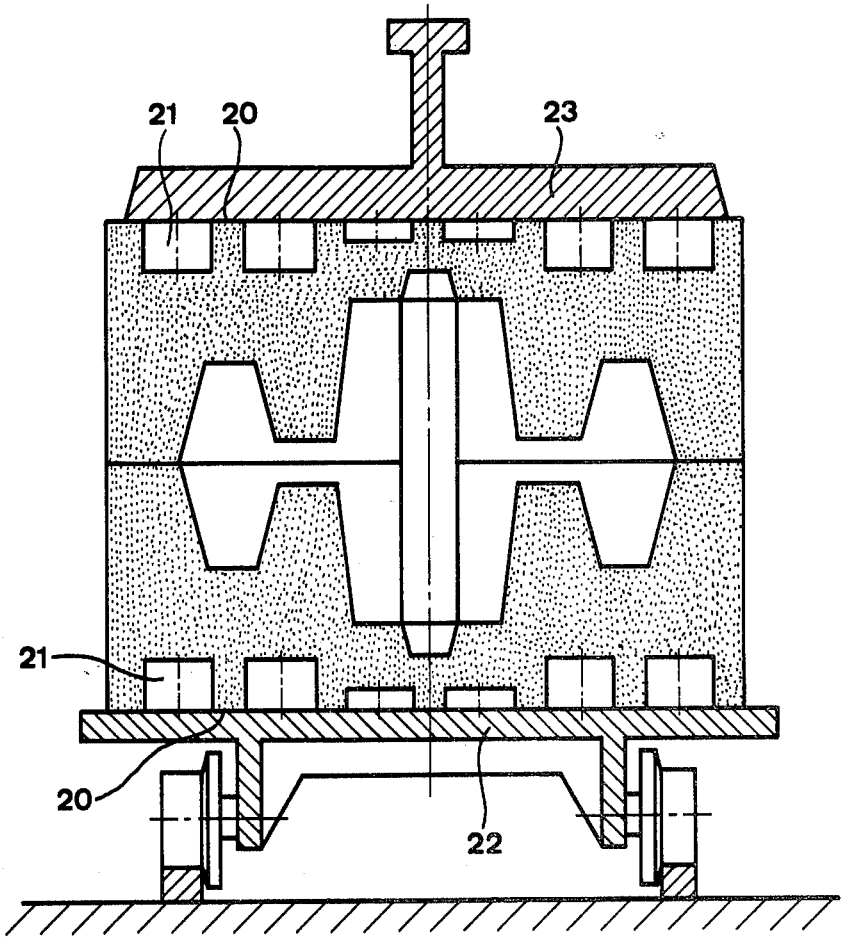
FIG. 3 illustrates in sectional view a casting mold composed of an upper mold part and a lower mold part during transport in the foundry.

The mold part which has been produced with the inventive apparatus now will be seen to have a flat or planar surface 20 which is only interrupted by substantially circular recesses or depressions 21 arranged at a uniform spacing and caused by the action of the press punches 12, so that the ejection of such formed mold part out of the mold box 4 can be accomplished without any problem (FIG. 2). At the finished mold part the flat surface 20 together with the recesses 21 at the lower part produces a positive standing or support surface at the support plate of a transport carriage or car 22 and at the upper mold part such flat or planar surface 20 forms a suitable contact surface for a weighting plate 23 or the like, as best seen by referring to FIG. 3.

The arrangement of the press punches 12 in the compaction plate 8 at the same spacing from one another appears to be advantageous, because in this manner the mold part is divided at uniform partial regions for the post-compaction, so that also when changing patterns there can be obtained a mold part at which the partial regions are approximately uniformly compacted. In the case of larger series production it is however also conceivable to arrange the press punches, corresponding to the employed patterns, at different spacings, and also a shape deviating from the cylindrical configuration can be provided for the press punches.

While there are shown and described present preferred embodiments of the invention, it is to distinctly understood that the invention is not limited thereto, but may be otherwise variously embodied and practiced within the scope of the following claims. Accordingly,

What I claim is:

1. An apparatus for manufacturing boxless casting mold parts, comprising:

a match plate support for carrying a pattern;

a molding box disposed upon said match plate support and serving for the reception of molding sand from a sand filling device;

a compaction device moveable to a work position between said sand-filling device and said molding box;

said compaction device being provided with a hollow chamber;

means for infeeding a pressurized fluid medium to said hollow chamber;

a plurality of displacable press punches serving for post-compaction of the sand in said mold box and protruding into said hollow chamber;

said compaction device comprising a compaction plate receivable within said molding box for pre-compaction of the sand; and said compaction plate being provided with recess means for receiving and arranging said press punches at a spacing from one another such that following compaction of the sand there is formed a coherent ejection and contact surface which is interrupted by recesses.

2. The apparatus as defined in claim 1, wherein:

the press punches are arranged essentially at the same spacing from one another in said compaction plate.

3. The apparatus as defined in claim 1, wherein:

said recess means of said compaction plate being provided with projection means.

4. The apparatus as defined in claim 1, wherein:

each of said compaction punches is structured as a cylinder.

5. The apparatus as defined in claim 4, wherein:

each of said press punches is provided with a substantially outwardly conical projection at a location below said compaction plate and a substantially cylindrical projection located within said hollow chamber.

6. The apparatus as defined in claim 1, wherein:

said hollow chamber is provided with boundary cam means for said press punches.

7. The apparatus as defined in claim 1, wherein:

said means for the infeed of the pressurized fluid medium to said hollow chamber comprises connection means for a hydraulic pressurized fluid medium.

8. The apparatus as defined in claim 1, wherein:

said means for the infeed of said pressurized fluid medium comprises connection means for a pneumatic pressurized fluid medium.

* * * * *